US006694758B1

(12) United States Patent
Cho et al.

(10) Patent No.: US 6,694,758 B1
(45) Date of Patent: Feb. 24, 2004

(54) APPARATUS AND METHOD FOR CONTROLLING CONCENTRATED COOLING OF REFRIGERATOR

(75) Inventors: Seong-Ho Cho, Seoul (KR); In-Seop Lee, Gyeonggi-Do (KR); In-Won Lee, Gyeonggi-Do (KR); Jae-Yong Sung, Seoul (KR); Jay-Ho Choi, Seoul (KR); Kwang-Hyup An, Seoul (KR); Jeong-Ho Lee, Gyeonggi-Do (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/310,938

(22) Filed: Dec. 6, 2002

(30) Foreign Application Priority Data

Aug. 14, 2002 (KR) ..... 2002/48258
Aug. 20, 2002 (KR) ..... 2002/49260

(51) Int. Cl.[7] ..... F25D 17/00; F25D 17/04
(52) U.S. Cl. ..... 62/179; 62/186; 62/408
(58) Field of Search ..... 62/179, 186, 408, 62/413, 414, 404, 89, 235; 236/49.3; 454/108, 154, 305

(56) References Cited

U.S. PATENT DOCUMENTS 4,912,943 A * 4/1990 Hubert et al. ..... 62/374
5,737,935 A * 4/1998 Heo ..... 62/186
5,775,124 A * 7/1998 Park et al. ..... 62/408
5,778,688 A * 7/1998 Park et al. ..... 62/89
5,907,953 A * 6/1999 Kang et al. ..... 62/89
6,055,820 A * 5/2000 Jeong et al. ..... 62/186
6,622,504 B2 * 9/2003 Lee et al. ..... 62/186

* cited by examiner

*Primary Examiner*—Marc Norman
(74) *Attorney, Agent, or Firm*—Greenblum & Bernstein, P.L.C.

(57) ABSTRACT

An apparatus and a method for controlling a concentrated cooling of a refrigerator for discharging cool air to a region where a load of high temperature is generated when the load is generated on a certain region in a cooling chamber due to receipt of food or opening of door comprises: a step of performing normal operation; a step of deciding whether the operating time reaches to a set time by counting the time; a step of blocking main discharge of cool air and detecting the load of high temperature by scanning, if it is decided that the set time is reached; and a step of rotating the nozzle to the region of the load and injecting cool air for a predetermined time, if the load of high temperature is detected in above step.

22 Claims, 9 Drawing Sheets

APPARATUS AND METHOD FOR CONTROLLING CONCENTRATED COOLING OF REFRIGERATOR

BACKGROUND OF THE INVENTION

1. Field of the Invention

The present invention relates to a refrigerator, and particularly, to an apparatus and a method for controlling a concentrated cooling of a refrigerator cools down a load of high temperature by injecting cool air intensively to a region where the load of high temperature is generated in a cool chamber.

2. Description of the Background Art

FIG. 1 is a perspective view showing a part of a refrigerator according to the conventional art, and FIG. 2 is a cross-sectional view showing a cool chamber of the conventional refrigerator.

The conventional refrigerator comprises: a main body 104 having a pair of doors opened/closed toward both directions and having a receiving space; a freezing chamber 106 disposed on left side of the main body 104 for storing frozen food; a cooling chamber 108 divided from the freezing chamber by a barrier wall and disposed on right side of the main body 104, having a plurality of racks on which food is received; and a cool air supplier installed on upper side of the freezing chamber for supplying cool air which is cooled down as passing through a refrigerating cycle (not shown) to the freezing chamber 106 and to the cooling chamber.

The cool air supplier comprises: a blast fan 120 mounted on upper rear wall surface of the freezing chamber 106 for forcedly blasting the cool air which is cooled down as passing through the refrigerating cycle; a panel 128 disposed on a lower side of the blast fan, having a plurality of discharge holes 130 for discharging the cool air into the freezing chamber 106; a cool air supplying path 132 formed on upper side of the barrier wall 110 so as to induce the cool air blasted from the blast fan 120 installed on the freezing chamber 106 into the cooling chamber 108; a cool air discharge duct 134 mounted on upper part of the freezing chamber 108 and connected to the cool air supplying path 132 for discharging the cool air supplied through the cool air supplying path 132 into the cooling chamber 108; and a cool air inlet 138, through which the cool air finishing its cooling function as circulating in the cooling chamber 108 is induced into the refrigerating cycle, formed on lower side of the barrier wall 110.

In addition, a temperature sensor 140 is adhered in the cooling chamber 108 for detecting the temperature of the cooling chamber, and a plurality of cool air discharge holes 136 for discharging the cool air into the cooling chamber 108 are formed on front and rear parts of the refrigerant discharge duct 134.

In the conventional refrigerator constructed as above, when the refrigerating cycle is operated and the blast fan 120 is rotated, the cool air which is cooled down as passing through the refrigerating cycle is discharged to the discharge hole 130 of the panel 128 and to the cool air supplying path 132 respectively.

The cool air discharged through the discharge hole 130 circulates in the freezing chamber 106 to freeze the frozen food stored in the freezing chamber 106.

In addition, the cool air supplied to the cool air supplying path 132 is induced into the cool air discharge duct 1334, and discharged into the cooling chamber through the cool air discharge hole 136 formed on the cool air discharge duct 134. The cool air discharged into the cooling chamber 108 circulates in the cooling chamber 108 to cool down the food stored in the cooling chamber 108, and the cooling air which finishes its the cooling function is induced into the cool air inlet 138 formed on the lower side of the barrier wall 110, and then, is cooled again as passing through the cooling cycle.

On the other hand, when the temperature detected by the temperature sensor is lower than a set value, the supplying of cooling air is blocked to prevent the cooling chamber from being super-cooled.

However, in the refrigerator according to the conventional art, the temperature sensor and the cool air discharge holes for discharging the cool air into the cooling chamber are disposed as fixed on certain regions, and therefore, the temperature detected by the temperature sensor is limited to a certain region in the cooling chamber, and the discharge of cool air is limited in the certain area. Therefore, if a load of high temperature is generated on a region out of the detecting range of the sensor by receiving food, it can not be identified promptly, and therefore, temperature variation is increased and the freshness of the food is lowered.

Especially, since the cool air discharge hole is disposed on the certain region of the cooling chamber, the food around the discharge hole is super-cooled due to the cool air, and the food stored around the door which is apart from the discharge hole can not be cooled enough.

SUMMARY OF THE INVENTION

Therefore, an object of the present invention is to provide an apparatus and a method for controlling a concentrated cooling of a refrigerator which are able to improve freshness of food by cooling down a load of high temperature rapidly and to maintain temperature in a cooling chamber in a short time, by discharging cool air intensively to a region where the load of high temperature is generated when the load of high temperature due to food receipt and opening/closing of door.

To achieve the object of the present invention, there is provided an apparatus for controlling a concentrated cooling of the refrigerator comprising: a nozzle driving unit mounted on one side of a nozzle, which is installed on a side wall of a cooling chamber to be rotatable for injecting cool air into the cooling chamber, for rotating the nozzle as a certain step angle; an infrared sensor mounted on front side of the nozzle for scanning temperature in the cooling chamber as rotating with the nozzle; a timer for counting the time that the refrigerator is normally operated; a damper for selectively opening a cool air discharge duct discharging the cool air into the cooling chamber and a cool air guiding path for guiding the cool air into the nozzle side; and a control unit for controlling the damper and the nozzle driving unit according to electric signal outputted from the infrared sensor and the timer.

The nozzle of the apparatus for controlling concentrated cooling comprises: a cool air injecting hole for injecting the cool air supplied through the cool air guiding path intensively into a region a load is generated; and a sensor receiving recess in which the infrared sensor accepted.

The apparatus for controlling concentrated cooling of the refrigerator further comprises a load amount calculation unit calculating cooling air injecting angle and injecting time according to the temperature and size of the high temperature load based on values inputted from the infrared sensor.

The apparatus for controlling concentration of the refrigerator further comprises a nozzle switch for opening/closing the nozzle injecting hole on the nozzle according to a signal applied from the control unit.

The apparatus for controlling concentrated cooling of the refrigerator comprises: a nozzle driving unit mounted on one side of the nozzle, which is installed on a side wall of a cooling chamber to be rotatable for injecting cool air into the cooling chamber, for rotating the nozzle as a certain step angle; an infrared sensor mounted on front part of the nozzle for scanning temperature in the cooling chamber as rotated with the nozzle; a door sensor mounted on one side of the refrigerator for sensing opening/closing of door; a damper for opening selectively a cool air discharge duct for discharging the cool air into a cooling chamber and a cool air guiding path for guiding the cool air into the nozzle side; and a control unit for controlling the damper and the nozzle driving unit according to electric signals outputted from the infrared sensor and the door sensor.

The apparatus for controlling the concentrated cooling of the refrigerator comprises: a nozzle driving unit mounted on one side of the nozzle, which is installed on a side wall of a cooling chamber to be rotatable for injecting cool air into the cooling chamber, for rotating the nozzle as a certain step angle; an infrared sensor mounted on front part of the nozzle for scanning temperature in the cooling chamber as rotated with the nozzle; a timer for counting the time that the refrigerator is normally operated; a door sensor mounted on one side of the refrigerator for sensing opening/closing of door; a damper for opening selectively a cool air discharge duct for discharging the cool air into a cooling chamber and a cool air guiding path for guiding the cool air into the nozzle side; and a control unit for controlling the damper and the nozzle driving unit according to electric signals outputted from the infrared sensor and the door sensor.

A method for controlling concentrated cooling of the refrigerator according to the present invention comprises: a first step of performing normal cooling operation; a second step of counting normal operating time from the point that the normal operation is started; a third step for deciding whether or not the normal operating time reaches to a set time; a fourth step for blocking discharge of cooling air and detecting a load of high temperature by scanning the temperature in a cooling chamber, when it is decided that the set time is reached in the third step; a fifth step for rotating a nozzle so that an injecting hole of the nozzle faces the region where the load is generated and for injecting the cool air for a predetermined time, when it is decided that the load of high temperature is generated in the fourth step; a sixth step for scanning the temperature in the cooling chamber when the cooling air injection is completed from the nozzle in the fifth step; and a seventh step for performing normal operation when it is decided that a load of high temperature is not detected by scanning the cooling chamber in the sixth step.

In the fifth step of the method for controlling concentrated cooling, the infrared sensor attached on front side of the nozzle detects the temperature value of respective regions in the cooling chamber and applies the values to the control unit by respective steps.

The fifth step of the controlling method comprises: a step of making temperature distribution of the cooling chamber based on the temperature values detected by the infrared sensor; a step of finding a position of a load of high temperature which is newly inserted based on the temperature distribution made in above step; and a step of setting an injecting angle of the nozzle toward the position of the load and controlling the injecting direction of the nozzle.

In the step of making temperature distribution, the temperature distribution is made by compensating temperature values obtained by respective steps appropriately, considering a scanning plane scanned by the infrared sensor, a viewing angle of the infrared sensor, distance from a substance and temperature variation according to sensing angle of the sensor.

In the step of finding the position of high temperature load, when the load of high temperature is found in a certain region of the cooling chamber, the control unit opens the cool air injecting hole disposed on the region where the load is generated, and closes the cool air injecting holes on other regions by operating the nozzle switch.

In the step of setting the injecting direction of the nozzle in the controlling method, the injecting direction is set considering the distance between the high temperature load and the nozzle and a trace of the cool air according to injecting speed.

The method for controlling the concentrated cooling comprises: a first step performing a normal cooling operation; a second step deciding whether or not a set time is reached by counting the normal operating time from the starting point of operation; a third step grasping opening/closing of door of the refrigerator, and performing main cool air discharging for a predetermined time when it is decided that the door is opened/closed; a fourth step rotating a nozzle so that a nozzle injecting hole on the nozzle faces the region where a load of high temperature is generated and injecting cool air for a predetermined time when it is decided that the load of high temperature is detected in the second step; a fifth step scanning temperature in the cooling chamber when the cool air injecting is completed from the nozzle in the fourth step; and a sixth step performing a normal operation when it is decided that a load of high temperature is not detected after scanning the inner temperature of the cooling chamber in the fifth step.

In the step of finding position of the high temperature load, when the load of high temperature is found on a region of the cooling chamber, the control unit opens the cool air injecting hole disposed on the region where the load is generated, and closes the cool air injecting holes of other nozzles by operating the nozzle switch.

The method for controlling the concentrated cooling comprises: a first step performing a normal cooling operation; a second step deciding whether or not a set time is reached by counting the normal operating time from the starting point of operation; a third step blocking main discharge of cool air when it is decided that the normal operating time reaches to the set time; a fourth step grasping opening/closing of door of the refrigerator; a fifth step performing main discharging of the cool air for a predetermined time and blocking the main discharging, when it is decided that the door is opened/closed; a sixth step detecting a load of high temperature by scanning temperature in the cooling chamber, when the main discharging of the cool air is blocked in the third and fifth steps; a seventh step rotating a nozzle so that a nozzle injecting hole on the nozzle faces the region where a load of high temperature is generated and injecting cool air for a predetermined time when it is decided that the load of high temperature is detected in the sixth step; an eighth step scanning temperature in the cooling chamber when the cool air injecting is completed from the nozzle in the seventh step; and a ninth step performing a normal operation when it is decided that a load of high temperature is not detected after scanning the inner temperature of the cooling chamber in the eighth step.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments for a refrigerator including a concentrated cooling apparatus according to the present invention, and the most preferred embodiment will be described as follows.

Figure 1:
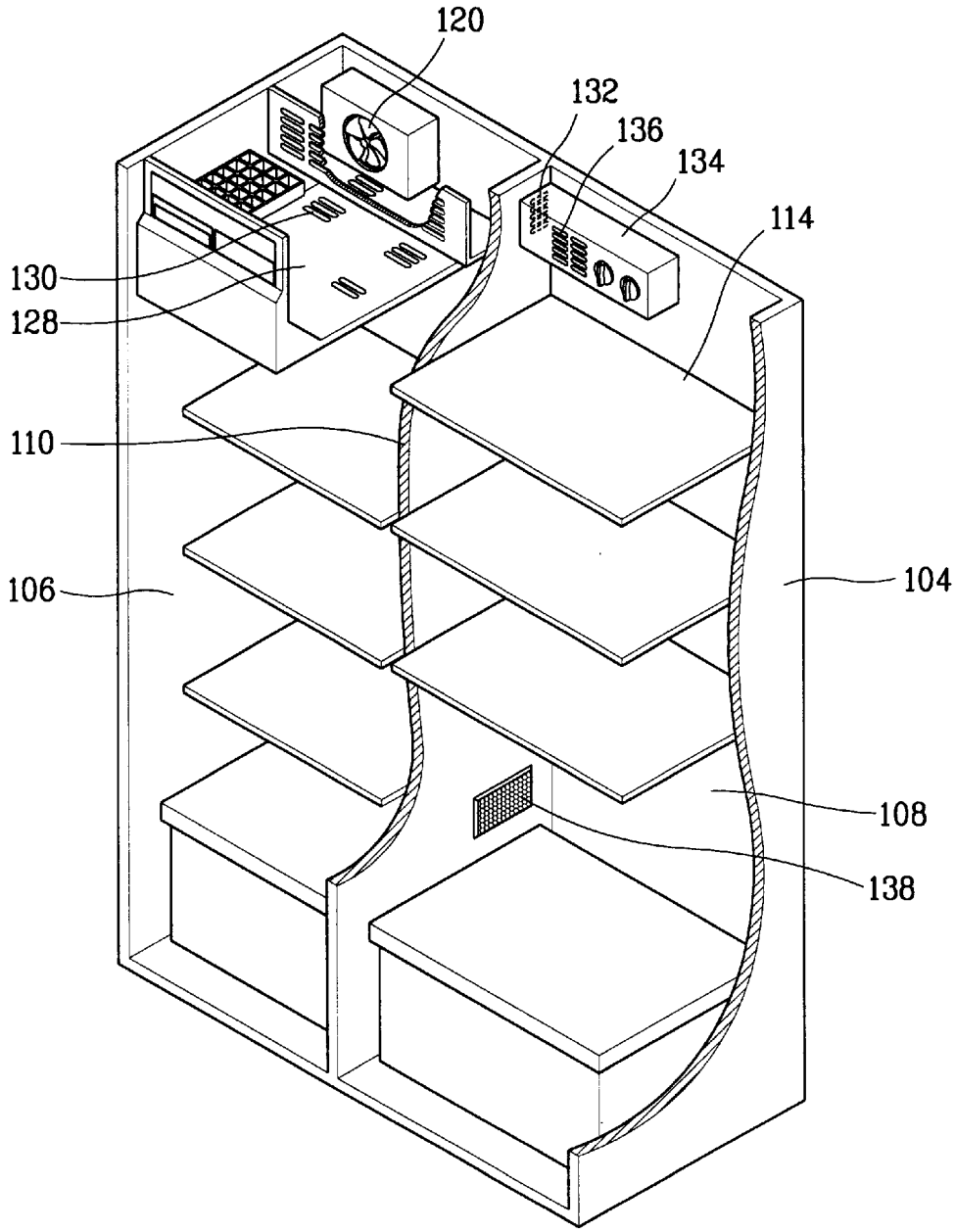
FIG. 1 CONVENTIONAL ART
FIG. 1 is a perspective view showing a part cut from a refrigerator according to the conventional art.
Figure 2:
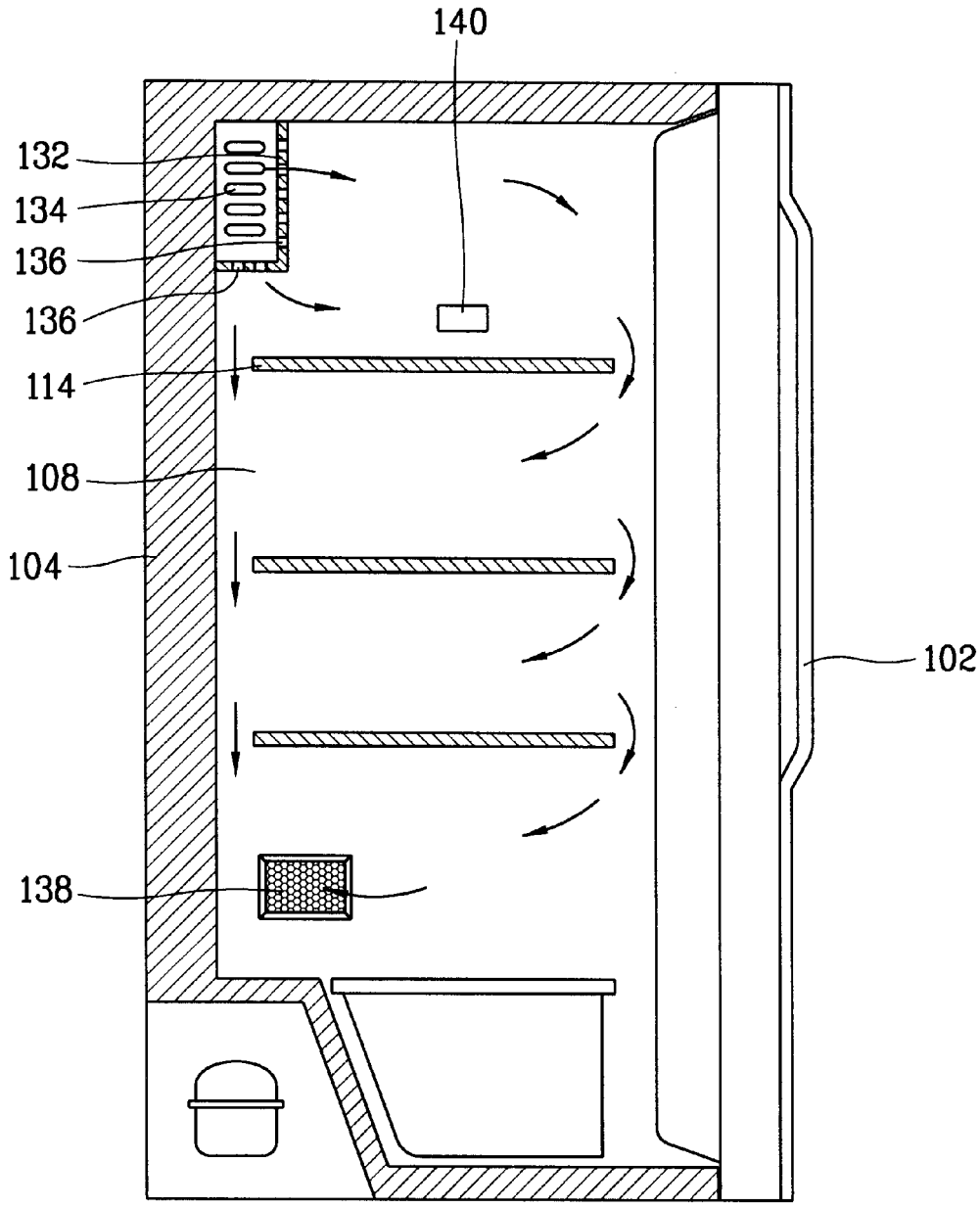
FIG. 2 CONVENTIONAL ART
FIG. 2 is a cross-sectional view showing a cooling chamber according to the conventional art.
Figure 3:
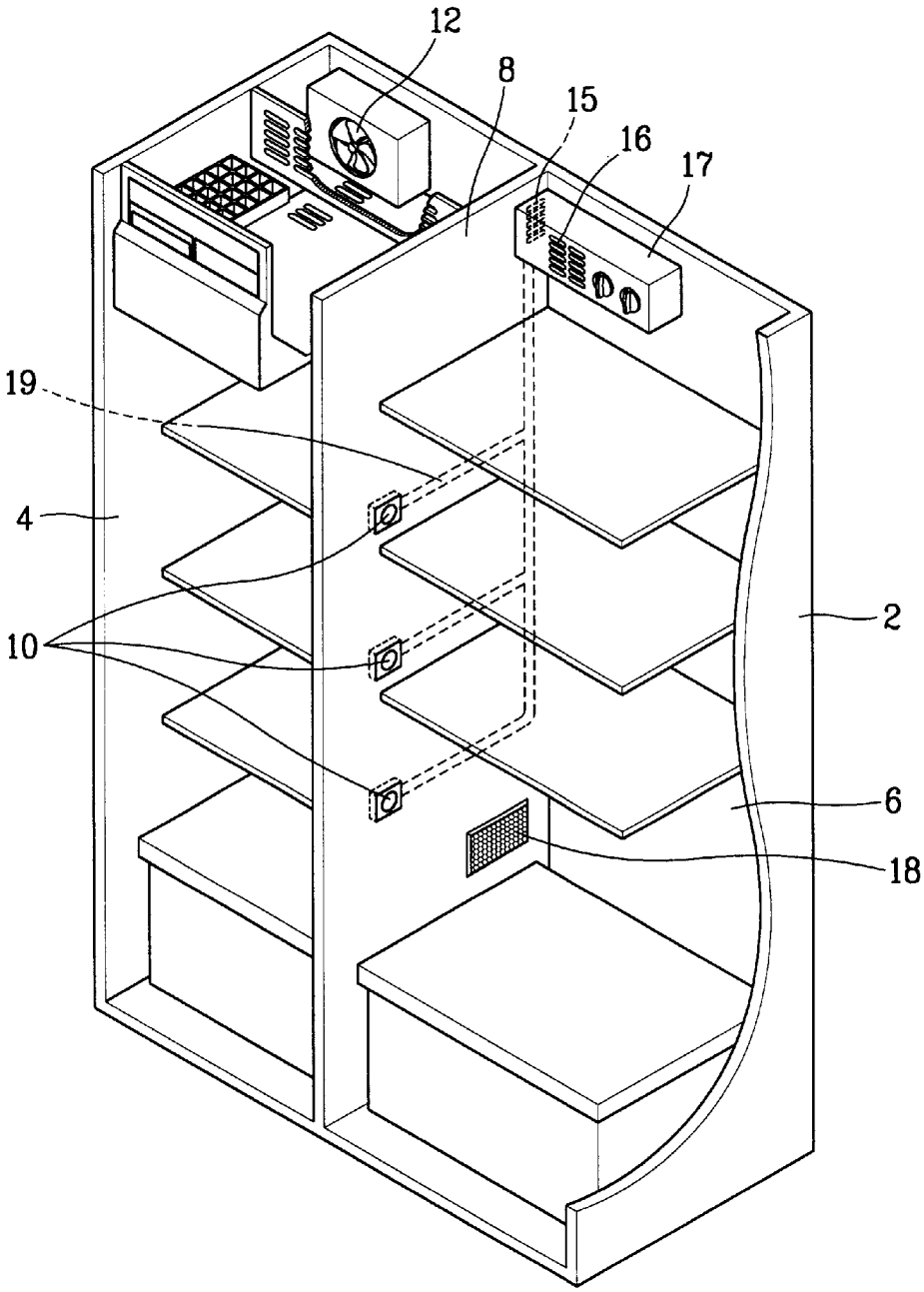
FIG. 3 is a perspective view showing a part cut from a refrigerator including a concentrated cooling apparatus according to the present invention.
Figure 4:
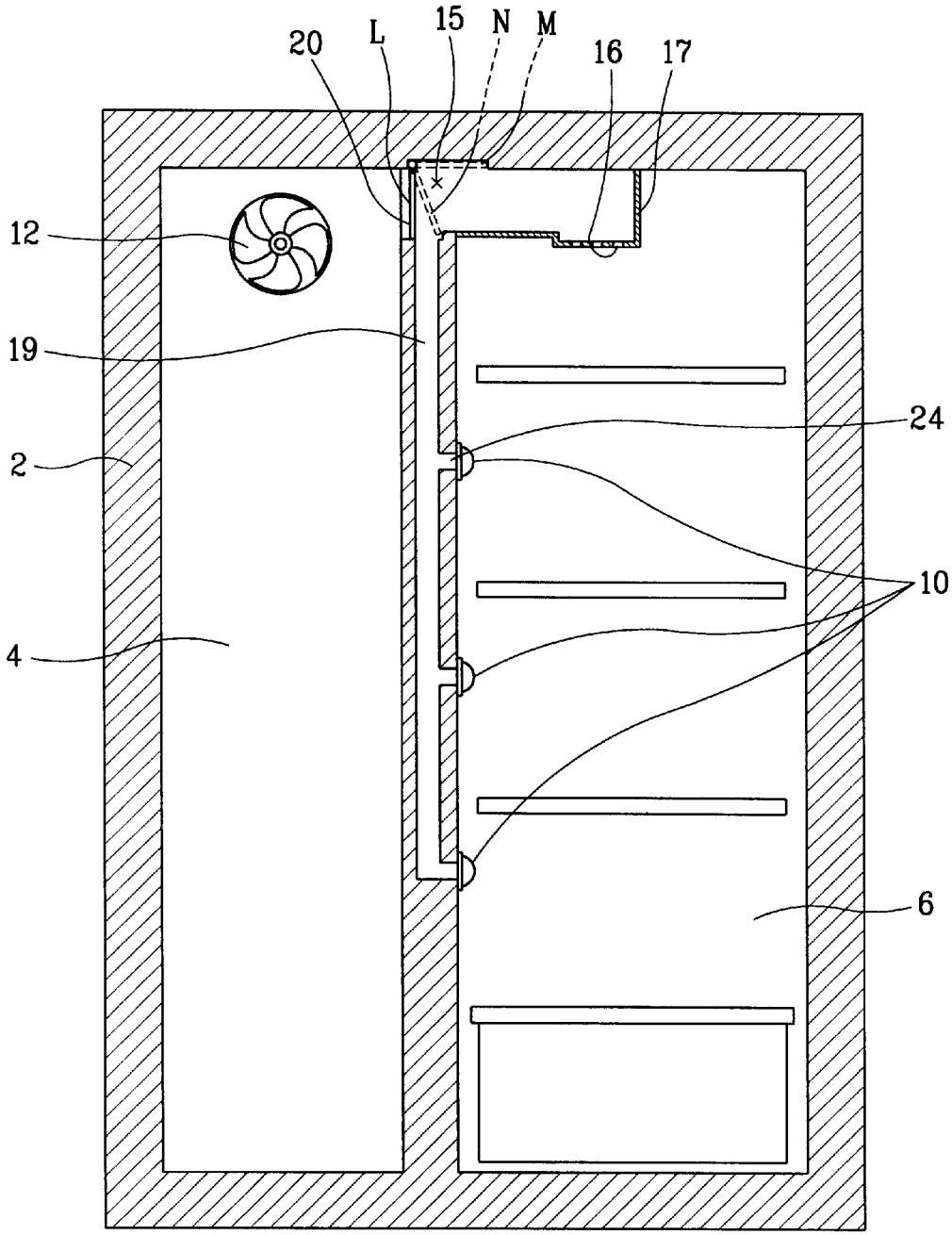
FIG. 4 is a cross-sectional view showing the refrigerating having the concentrated cooling apparatus according to the present invention.

FIG. 3 is a perspective view showing a part cut from the refrigerator according to the present invention, and FIG. 4 is a cross-sectional view showing the refrigerator according to the present invention.

The refrigerator according to the present invention comprises: a main body 2 having doors (not shown) opened/closed toward both side directions on front side, and a receipt space on which food is stored; a freezing chamber 4 formed on one of left/right sides for storing frozen food; a cooling chamber 6 partitioned from the freezing chamber 4 by a barrier wall 8 for storing chilled food; a refrigerating cycle (not shown) installed on one side of the main body 2 for generating cool air; a cool air supplier for supplying the air cooled down as passing through the refrigerating cycle to the freezing chamber 4 and to the cooling chamber 6; a concentrated cooling apparatus 10 for discharging the cool air to a region where a load of high temperature is generated, when the load of high temperature is generated in a certain region in the cooling chamber 6; and a controller for controlling the concentrated cooling apparatus.

The cool air supplier comprises: a blast fan 12 adhered on upper rear wall of the freezing chamber 4 for forcedly circulating the cool air cooled down as passing through the refrigerating cycle; a cool air supplying path 15 formed on upper part of the barrier wall 8 for supplying the cool air blasted by the blast fan 12 into the cooling chamber 6; and a cool air discharge duct 17 connected to the cool air supplying path 15 and installed on upper part of the cooling chamber, and having a cool air discharge hole 16 for discharging the cool air on upper part of the cooling chamber 6.

In addition, a cool air inlet 18 for inducing the cool air which finishes its cooling operating as circulating in the cooling chamber 6 into the refrigerating cycle is formed on a lower part of the barrier wall 8.

Figure 5:
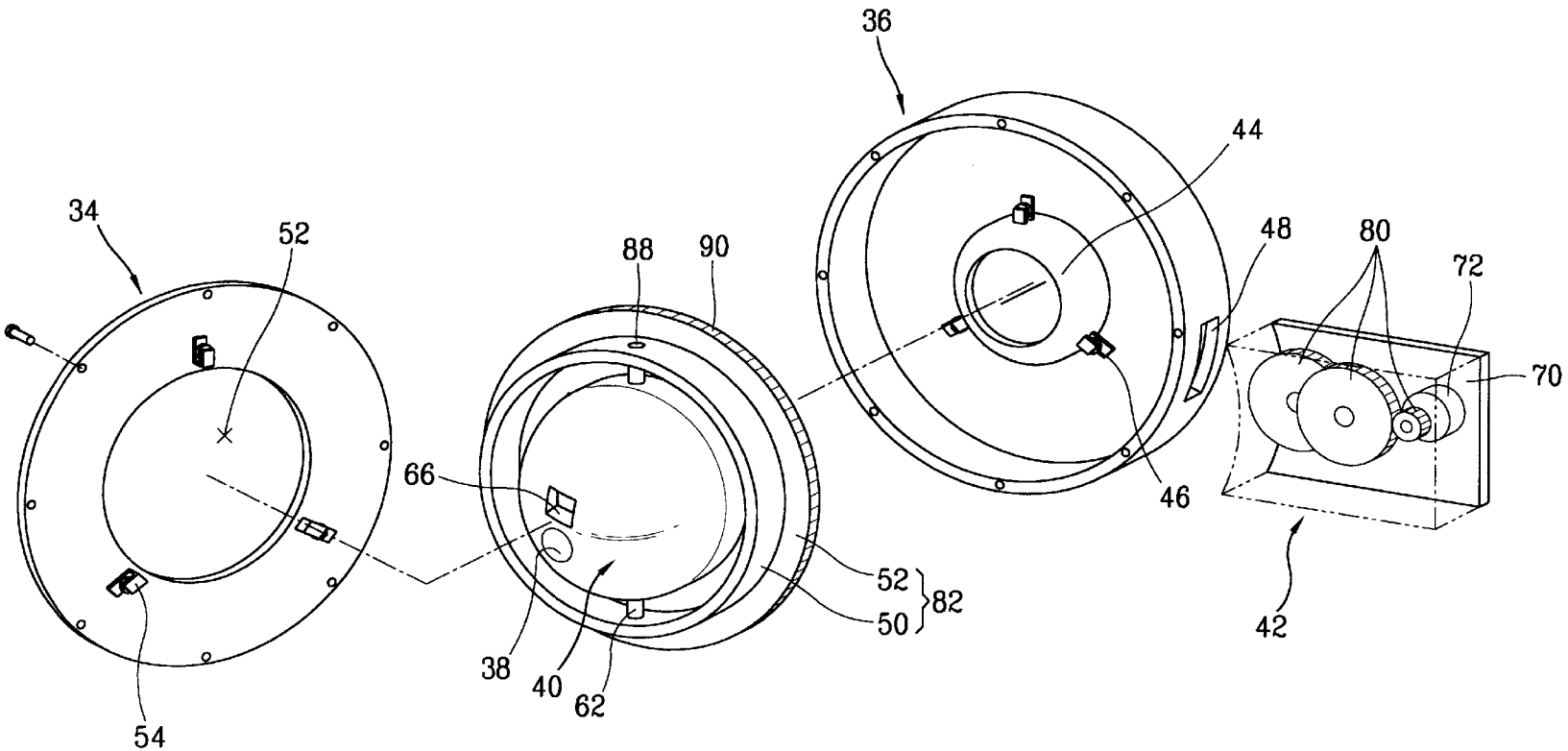
FIG. 5 is an exploded perspective view showing the concentrated cooling apparatus according to the present invention.
Figure 6:
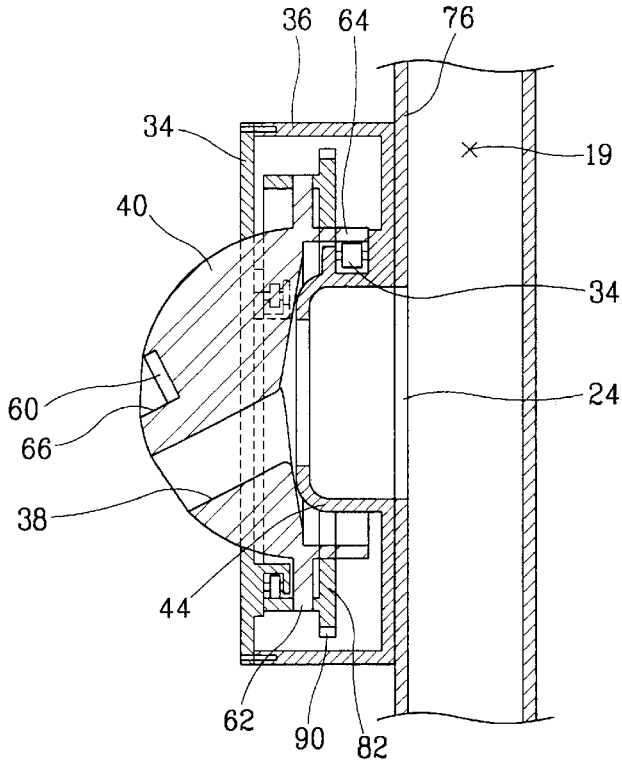
FIG. 6 is a cross-sectional view showing the concentrated cooling apparatus according to the present invention.

FIG. 5 is an exploded perspective view showing a cool air injecting apparatus according to the present invention, and FIG. 6 is a cross-sectional view showing the cool air injecting apparatus according to the present invention.

The concentrated cooling apparatus 1o comprises: a cool air guiding path 19 connected to the cool air supplying path 15 formed on the barrier wall 10 and formed on a side wall of the cooling chamber 6 for guiding the cool air to the side wall of the cooling chamber; a housing 36 mounted on the cool air guiding path 19 with a predetermined gap therebetween; a nozzle supported by the housing 36 so as to be rotatable, in order to inject the cool air to the region where the load of high temperature is generated; an infrared sensor 60 mounted on a front part of the nozzle 40 for detecting the region where the load of high temperature is generated as rotating with the nozzle 40; and a nozzle driving unit rotating the nozzle 40.

A damper 20 is installed on the cool air supplying path 15 for opening selectively the cool air discharge duct 17 and the cool air guiding path 19.

The damper 20 is mounted on one side of the cool air supplying path 15 to be rotatable, and is operated by an additional driving device. And when the damper 20 is positioned on a first position (L), the cool air supplying to the freezing chamber 6 is blocked. In addition, when the damper 20 is positioned on a second position (M), the cool air supplying to the cool air discharge duct 17 is blocked, and when it is on a third position (N), the cool air is supplied to the cool air guiding path 19 and to the cool air discharge duct 17.

The housing 36 is a cylindrical shape with opened upper side. In addition, contacting protrusion 44, to which the nozzle 40 is contacted, penetrates the housing 36 from a center of bottom surface to inner direction so as to be connected to a cool air guiding hole 24 of the cool air guiding path, a plurality of first supporting rollers 46 supporting the nozzle 40 to be rotatable are mounted in circumferential direction of the contacting protrusion 44 with predetermined intervals therebetween, and the nozzle driving unit 42 is mounted on one side of the housing 36.

A cover 34 mounted on the opened upper surface of the housing 36 comprises a nozzle inserting hole 52 into which the nozzle 40 is inserted on center part thereof, and a plurality of second supporting rollers 54 are mounted in circumferential direction of the nozzle inserting hole 52 with same intervals therebetween on lower surface of the upper housing 34.

The nozzle 40 is formed as a hemisphere. In addition, the nozzle 40 is inserted into the nozzle inserting hole 52 of the cover 34, and therefore, the upper part of the nozzle 40 is exposed toward front part of the cover 34 and the lower inner circumferential surface is contacted to the contacting protrusion 44 of the housing 36.

In addition, a cool air injection hole 38 for injecting the cool air into the cooling chamber 6 is formed as penetrating the nozzle 40, and the infrared sensor 60 for detecting the temperature in the cooling chamber 6 is attached on the upper surface of the nozzle 40. In addition, a connecting rod 62 is formed on lower side of the nozzle 40 to be connected to the nozzle driving unit 42, and a guide portion 64 of cylindrical shape, which is supported by the first supporting rollers 46 mounted on the lower housing 36 to be rotatable, is formed.

A nozzle switch 96 is disposed on one side of the nozzle 40 for opening/closing the cool air injecting hole 38. That is, the nozzle switch 96 opens the cool air injecting hole of a nozzle mounted on the region where the load of high temperature is generated, and closes the cool air injecting holes of the other nozzles.

The nozzle switch 96 can be modified variously, for example, may be formed on upper surface of the cover 34 as a nozzle cover type and closes the cool air injecting hole 38 according to rotation of the nozzle 40, or may open/close the cool air injecting hole 38 by installing a damper or a blast fan on the cool air injection hole 38.

Herein, the cool air injecting hole 38 is formed to be slant as a predetermined angle from lower surface center of the nozzle 40, and the outlet through which the cool air is discharged is formed on a position eccentric to one side from the center of the nozzle 40.

In addition, the infrared sensor 60 is mounted on a nozzle receiving recess 66 formed on the upper surface of the nozzle 40, and detects the temperature by receiving infrared ray radiated from a heat source on front part of the cool air injecting hole 38.

The nozzle driving unit 42 comprises: a gear box 70 mounted on one side of the housing 36; a stepping motor 72 built in the gear box 70 for generating driving force; and a nozzle supporting member 82, on which the connecting rod 62 connected to the nozzle 40 is fixed, connected to the stepping motor 72 by a plurality of gears 80 for transmitting the driving force of the stepping motor 72 to the nozzle 40.

The nozzle supporting member 82 comprises a disc portion 84, in which an outer circumferential surface of the guide portion 64 of the nozzle 40 is inserted, geared with the gear 80, and a cylinder portion 86 extended vertically from the disc portion 84, having a mounting hole 88 in which the connecting rode 62 is inserted.

Figure 7:
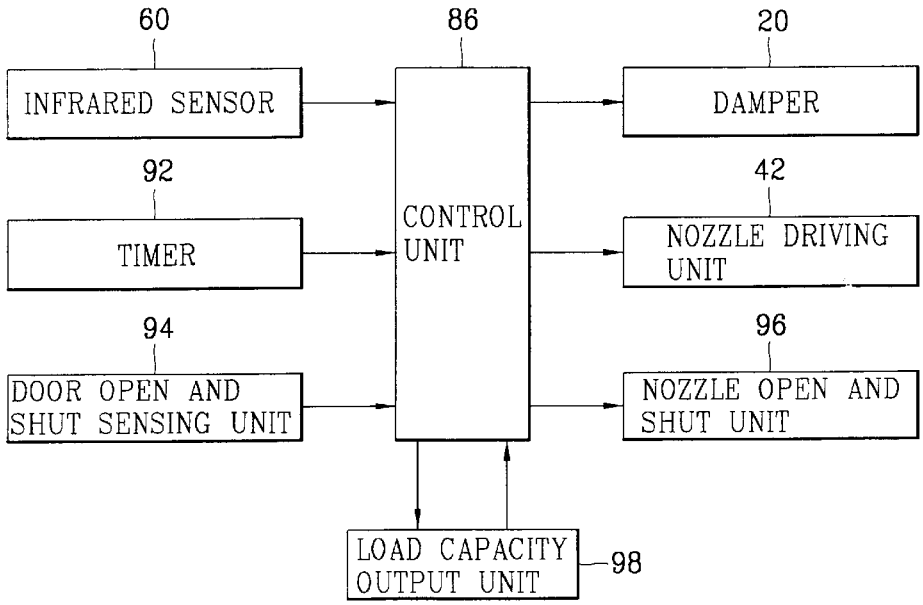
FIG. 7 is a block diagram showing the apparatus for controlling concentrated cooling according to the present invention.

FIG. 7 is a block diagram showing a controlling apparatus for controlling the concentrated cooling apparatus according to the present invention.

The controlling apparatus comprises: a control unit 86; an infrared sensor 60 for detecting the load of high temperature by scanning the temperature in the cooling chamber 6; a timer 92 for counting normal operation time of the refrigerator; a load amount calculation unit 98 for calculating cool air injecting direction and injection amount according to the position, temperature and size of high temperature load based on an input value inputted from the infrared sensor 60; a damper 20 operated according to signal outputted from the control unit 86; and a nozzle driving unit 42.

In addition, a door sensor 94 for detecting opening/closing of the cooling chamber door (not shown) and applying the status of door to the control unit 86 is installed on one side of the cooling chamber 6.

The control unit 86 opens the nozzle located on the region where the load of high temperature is generated and closed the nozzles located on other regions by controlling the nozzle switch 96 installed on one side of the nozzle 40.

Hereinafter, a method for controlling the concentrated cooling according to operations of the controlling apparatus will be described as follows.

Figure 8:
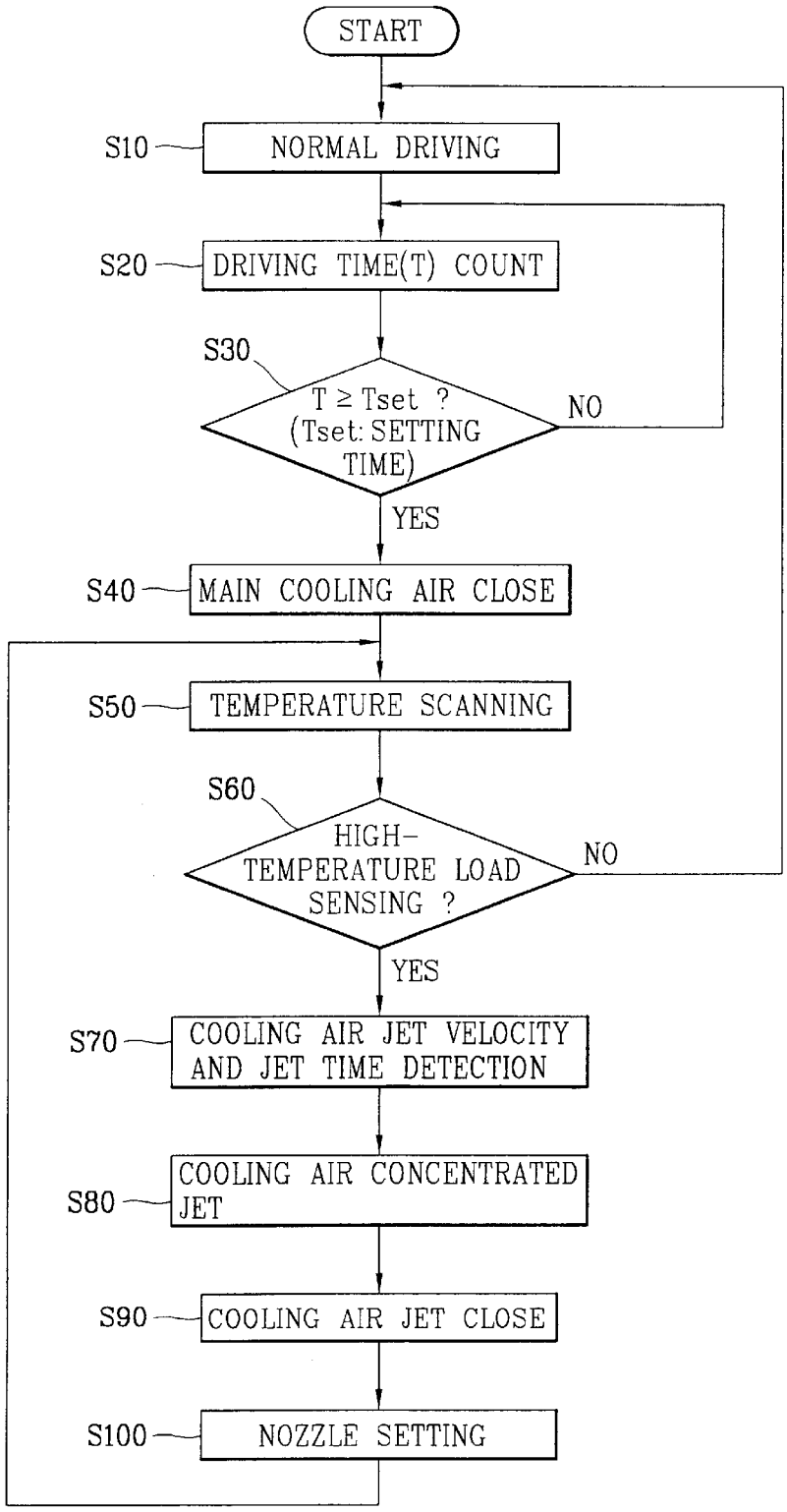
FIG. 8 is a flow chart illustrating a method for controlling concentrated cooling according to the present invention.

FIG. 8 is a flow chart illustrating the method for controlling the concentrated cooling of the refrigerator according to an embodiment of the present invention.

To begin with, the air which is cooled down as passing through the refrigerating cycle by driving of the blast fan 12 is supplied to the cooling chamber 6 through the cool air supplying path 15 formed on the barrier wall 8. The cool air supplied through the cool air supplying path 15 is discharged mainly through the cool air discharge duct 17 into the cooling chamber 6 to cool down the cooling chamber 6 (S10).

At that time, the damper 20 is operated on the third position to open the cool air guiding path 19 and the cool air discharge duct 17.

With the starting of the normal operation as above, the timer 92 is operated to count the normal operation proceeded time (S20). If the normal operation time detected by the timer 92 passes over the set time, the main supplying of the cool air into the cooling chamber 6 is blocked (S30 and S40).

That is, when the control unit 86 decides that the operating time applied from the timer 92 passes over the set time, operates the damper 20 on the second position (M). then, the main supplying of the cool air to the cool air discharge duct 17 is blocked.

When the main supply of the cool air is blocked as above, the temperature in the cooling chamber is scanned to detect the load of high temperature on respective regions (S50).

That is, when the control unit 86 operates the nozzle driving unit 42 to rotate the nozzle 40, the infrared sensor 60 mounted on the nozzle 40 applies the temperature values on the respective regions of the cooling chamber 6 to the control unit 86 by respective steps. Then, the control unit 86 applies the signal values transmitted from the infrared sensor 60 to the load amount calculation unit 98, and the load amount calculation unit 98 calculates the injecting speed and the injecting time of the cool air according to the size of the load and the distance from the load (S60 and S70).

Hereinafter, the operations of the load amount calculation unit will be described in more detail.

Figure 9:
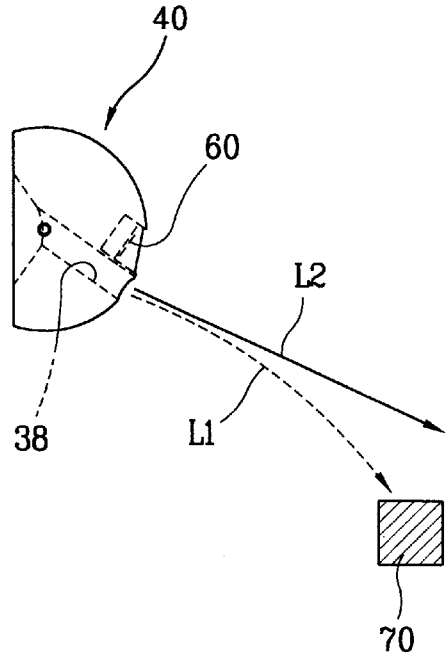
FIGS. 9 and 10 are views showing operational status representing a method for calculating load amount in the method for controlling the concentrated cooling according to the present invention.
Figure 10:
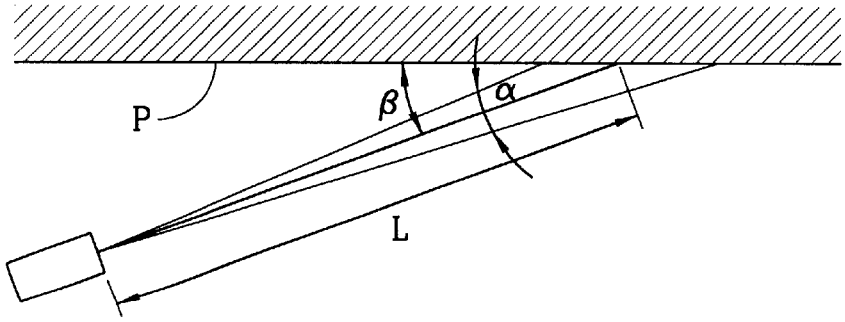

FIGS. 9 and 10 are views showing operational states of the load amount calculation unit in the concentrated cooling apparatus according to the present invention.

First, the infrared sensor 60 acquires the temperature values on respective regions in the cooling chamber 6 by respective steps, and then, the temperature distribution is made by compensating the temperature values appropriately considering temperature variation according to the scanning plane (P) scanned by the infrared sensor 60, a viewing angle ($\alpha$) of the infrared sensor 60, a distance from the load and the sensing angle ($\beta$) by the respective regions.

Based on the temperature distribution made as above, the location of high temperature load which is newly accepted is found. Herein, when it is decided that the load of high temperature is generated on a certain region in the cooling chamber, the control unit opens the cool air injecting hole disposed on the region where the load is generated, and closes the cool air injecting hole of other nozzles by operating the nozzle switch.

When the location of the high temperature load is grasped, the injecting angle of the nozzle 40 selected among the nozzles and the injecting direction is controlled. At that time, the injecting direction L2 of the nozzle 40 is set by considering the distance (L) between the load and the nozzle and the trace of the cool air (L1) according to the cool air injecting speed.

As described above, when the injecting direction (L2) of the nozzle 40 is set, the cool air injecting time is set by a function according to the temperature of the load, and the cool air is injected intensively (S80).

In above, when the cool air injecting time has passed since the injection was started, the nozzle is returned to the original position and the damper 20 is operated on the third position to perform the normal operation of the refrigerator (S90 and S100).

Figure 11:
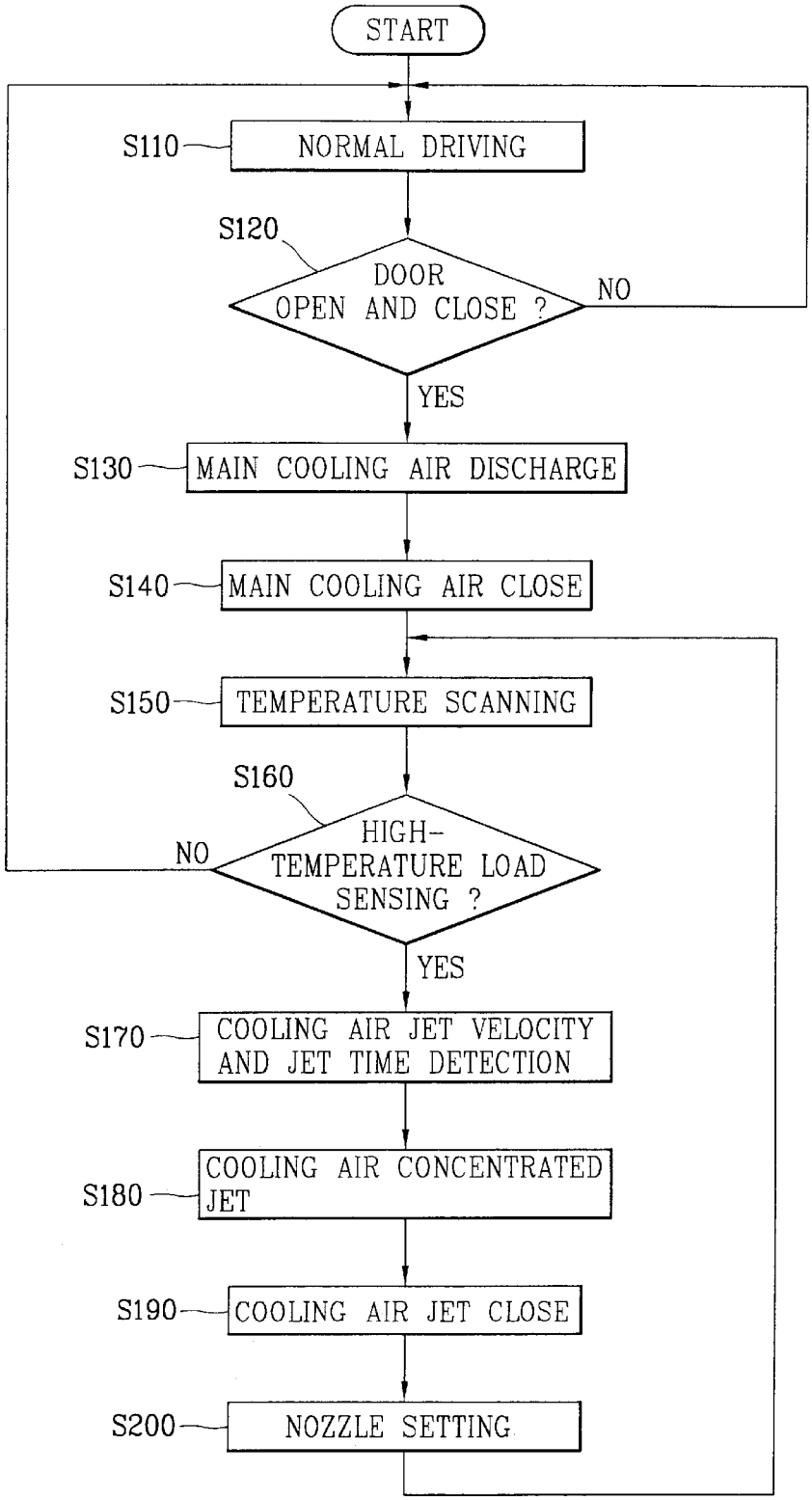
FIG. 11 is a flow chart illustrating a method for controlling concentrated cooling according to another embodiment of the present invention.

FIG. 11 is a flow chart illustrating a method for controlling the concentrated cooling according to another embodiment of the present invention.

First, the air which is cooled down as passing through the refrigerating cycle by the driving of the blast fan 12 is supplied into the cooling chamber 6 through the cool air supplying path 15 formed on the barrier wall 8. The cool air supplied to the cool air supplying path 15 is discharged into the cooling chamber 6 through the cool air discharge duct 17 to perform the cooling operation in the cooling chamber 6 (S110).

At that time, the damper 20 is operated on the third position to open the cool air guiding path 19 and the cool air discharge duct 17.

During the normal operation of the refrigerator, when the door is opened and closed, the main supplying of the cool air into the cooling chamber 6 is performed for a predetermined time (S120 and S130).

That is, the door is opened and closed, the door sensor 94 recognizes that, and applies the status to the control unit 86. Then, the control unit 86 rotates the damper 20 to the third position (N) to perform the main supplying of the cool air into the cooling chamber through the cool air discharge duct for a set time.

In addition, when the main supplying of the cool air has passed over the set time, the main cool air supplying is blocked (S140). That is, when control unit 86 decides that the supplying is made over the set time, rotates the damper 20 to the second position to block the main supplying of the cooling chamber 6.

After the main supplying of the cool air is blocked, the processes that the temperature in the cooling chamber is scanned and the cool air is injected intensively to the region where the load of high temperature is generated are same as those of the first embodiment, and therefore, the descriptions for the processes are omitted (S150~S200).

Also, as still another embodiment, when the cool air discharging time counted by the timer described in the first embodiment has passed over the set time or the door is opened/closed sensed by the door sensor described in the another embodiment, the temperature in the cooling chamber is scanned and the cool air is injected intensively to the region where the load of high temperature is generated.

Effects of the apparatus and method for concentrated cooling of the refrigerator according to the present invention will be described as follows.

When the normal operating time of the refrigerator has passed over the set time or the door of the refrigerator is opened and closed, the cool air is injected to the region where the load of high temperature is generated by controlling the nozzle if it is decided that the load of high temperature is generated by scanning the temperature in the cooling chamber. Thereby, the load of high temperature which is newly accepted in the cooling chamber can be cooled down rapidly.

Also, the cool air is injected only through the nozzle disposed on the region where the load is generated among the plurality of nozzles installed in the cooling chamber, and therefore, the cooling efficiency and the function can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling concentrated cooling of a refrigerator comprising:

a nozzle driving unit mounted on one side of a nozzle, which is installed on a side wall of a cooling chamber to be rotatable for injecting cool air into the cooling chamber, for rotating the nozzle as a certain step angle;

an infrared sensor mounted on front side of the nozzle for scanning temperature in the cooling chamber as rotating with the nozzle;

a timer for counting the time that the refrigerator is normally operated;

a damper for selectively opening a cool air discharge duct discharging the cool air into the cooling chamber and a cool air guiding path for guiding the cool air into the nozzle side; and a control unit for controlling the damper and the nozzle driving unit according to electric signal outputted from the infrared sensor and the timer.

2. The apparatus of claim 1, wherein the nozzle has a cool air injecting hole for injecting the cool air supplied through the cool air guiding path intensively into a region a load is generated, and a sensor receiving recess in which the infrared sensor accepted.

3. The apparatus of claim 1, wherein the damper is mounted on a cool air supplying path, which supplies the cool air into the cooling chamber, to be rotatable, and operated by a signal applied to the control unit to open selectively the cool air discharge duct and the cool air guiding path.

4. The apparatus of claim 1 further comprising a load amount calculation unit calculating cooling air injecting angle and injecting time according to the temperature and size of the high temperature load based on values inputted from the infrared sensor.

5. The apparatus of claim 1 further comprising a nozzle switch for opening/closing the nozzle injecting hole on the nozzle according to a signal applied from the control unit.

6. An apparatus for controlling concentrated cooling of a refrigerator comprising:

a nozzle driving unit mounted on one side of the nozzle, which is installed on a side wall of a cooling chamber to be rotatable for injecting cool air into the cooling chamber, for rotating the nozzle as a certain step angle;

an infrared sensor mounted on front part of the nozzle for scanning temperature in the cooling chamber as rotated with the nozzle;

a door sensor mounted on one side of the refrigerator for sensing opening/closing of door;

a damper for opening selectively a cool air discharge duct for discharging the cool air into a cooling chamber and a cool air guiding path for guiding the cool air into the nozzle side; and a control unit for controlling the damper and the nozzle driving unit according to electric signals outputted from the infrared sensor and the door sensor.

7. The apparatus of claim 6 further comprising a load amount calculation unit calculating cooling air injecting angle and injecting time according to the temperature and size of the high temperature load based on values inputted from the infrared sensor.

8. The apparatus of claim 6 further comprising a nozzle switch for opening/closing the nozzle injecting hole on the nozzle according to a signal applied from the control unit.

9. An apparatus for controlling concentrated cooling of a refrigerator comprising:

a nozzle driving unit mounted on one side of the nozzle, which is installed on a side wall of a cooling chamber to be rotatable for injecting cool air into the cooling chamber, for rotating the nozzle as a certain step angle;

an infrared sensor mounted on front part of the nozzle for scanning temperature in the cooling chamber as rotated with the nozzle;

a timer for counting the time that the refrigerator is normally operated;

a door sensor mounted on one side of the refrigerator for sensing opening/closing of door;

a damper for opening selectively a cool air discharge duct for discharging the cool air into a cooling chamber and a cool air guiding path for guiding the cool air into the nozzle side; and a control unit for controlling the damper and the nozzle driving unit according to electric signals outputted from the infrared sensor and the door sensor.

10. A method for controlling concentrated cooling of a refrigerator comprising:

a first step of performing normal cooling operation;

a second step of counting normal operating time from the point that the normal operation is started;

a third step for deciding whether or not the normal operating time reaches to a set time;

a fourth step for blocking discharge of cooling air and detecting a load of high temperature by scanning the temperature in a cooling chamber, when it is decided that the set time is reached in the third step;

a fifth step for rotating a nozzle so that an injecting hole of the nozzle faces the region where the load is generated and for injecting the cool air for a predetermined time, when it is decided that the load of high temperature is generated in the fourth step;

a sixth step for scanning the temperature in the cooling chamber when the cooling air injection is completed from the nozzle in the fifth step; and a seventh step for performing normal operation when it is decided that a load of high temperature is not detected by scanning the cooling chamber in the sixth step.

11. The method of claim 10, wherein an infrared sensor attached on front side of the nozzle detects temperature values of respective regions in the cooling chamber and applies the values to a control unit by respective steps, in the fifth step.

12. The method of claim 10, wherein the fifth step comprises:

a step of making temperature distribution of the cooling chamber based on the temperature values detected by an infrared sensor;

a step of finding a position of a load of high temperature which is newly inserted based on the temperature distribution made in above step; and a step of setting an injecting angle of the nozzle toward the position of the load and controlling the injecting direction of the nozzle.

13. The method of claim 12, wherein the step of making temperature distribution makes the temperature distribution by compensating temperature values obtained by respective steps appropriately, considering a scanning plane scanned by the infrared sensor, a viewing angle of the infrared sensor, distance from a substance and temperature variation according to sensing angle of the sensor.

14. The method of claim 12, wherein the control unit opens the cool air injecting hole disposed on the region where the load is generated, and closes the cool air injecting holes on other regions by operating the nozzle switch, when the load of high temperature is found in a certain region of the cooling chamber, in the step of finding the load of high temperature.

15. The method of claim 12, wherein the injecting direction is set considering the distance between the high temperature load and the nozzle and a trace of the cool air according to injecting speed, in the step of setting the injection direction of the nozzle.

16. The method of claim 10, wherein the cool air injecting time is set by a function according to the temperature of the load in the sixth step.

17. A method for controlling concentrated cooling of a refrigerator comprising:

a first step performing a normal cooling operation;

a second step deciding whether or not a set time is reached by counting the normal operating time from the starting point of operation;

a third step grasping opening/closing of door of the refrigerator, and performing main cool air discharging for a predetermined time when it is decided that the door is opened/closed;

a fourth step rotating a nozzle so that a nozzle injecting hole on the nozzle faces the region where a load of high temperature is generated and injecting cool air for a predetermined time when it is decided that the load of high temperature is detected in the second step;

a fifth step scanning temperature in the cooling chamber when the cool air injecting is completed from the nozzle in the fourth step; and a sixth step performing a normal operation when it is decided that a load of high temperature is not detected after scanning the inner temperature of the cooling chamber in the fifth step.

18. The method of claim 17, wherein the fifth step comprises:

a step of making temperature distribution of the cooling chamber based on the temperature values detected by an infrared sensor;

a step of finding a position of a load of high temperature which is newly inserted based on the temperature distribution made in above step; and a step of setting an injecting angle of the nozzle toward the position of the load and controlling the injecting direction of the nozzle.

19. The method of claim 18, wherein the step of making temperature distribution makes the temperature distribution by compensating temperature values obtained by respective steps appropriately, considering a scanning plane scanned by the infrared sensor, a viewing angle of the infrared sensor, distance from a substance and temperature variation according to sensing angle of the sensor.

20. The method of claim 18, wherein the control unit opens the cool air injecting hole disposed on the region where the load is generated, and closes the cool air injecting holes on other regions by operating the nozzle switch, when the load of high temperature is found in a certain region of the cooling chamber, in the step of finding the load of high temperature.

21. The method of claim 18, wherein the injecting direction is set considering the distance between the high temperature load and the nozzle and a trace of the cool air according to injecting speed, in the step of setting the injection direction of the nozzle.

22. A method for controlling concentrated cooling of a refrigerator comprising:

a first step performing a normal cooling operation;

a second step deciding whether or not a set time is reached by counting the normal operating time from the starting point of operation;

a third step blocking main discharge of cool air when it is decided that the normal operating time reaches to the set time;

a fourth step grasping opening/closing of door of the refrigerator;

a fifth step performing main discharging of the cool air for a predetermined time and blocking the main discharging, when it is decided that the door is opened/closed;

a sixth step detecting a load of high temperature by scanning temperature in the cooling chamber, when the main discharging of the cool air is blocked in the third and fifth steps;

a seventh step rotating a nozzle so that a nozzle injecting hole on the nozzle faces the region where a load of high temperature is generated and injecting cool air for a predetermined time when it is decided that the load of high temperature is detected in the sixth step;

an eighth step scanning temperature in the cooling chamber when the cool air injecting is completed from the nozzle in the seventh step; and a ninth step performing a normal operation when it is decided that a load of high temperature is not detected after scanning the inner temperature of the cooling chamber in the eighth step.

* * * * *